US005289752A

United States Patent [19]

Barbaglia

[11] Patent Number: 5,289,752

[45] Date of Patent: Mar. 1, 1994

[54] DEVICE FOR FASTENING THE REED ON THE MOUTHPIECE OF WIND INSTRUMENTS

[76] Inventor: Emilio Barbaglia, Via Misericordia 10, Abbiategrasso 20081 (Milano), Italy

[21] Appl. No.: 823,718

[22] Filed: Jan. 22, 1992

[30] Foreign Application Priority Data

Feb. 15, 1991 [IT] Italy ..... MI91A000396

[51] Int. Cl.[5] ..... G10D 9/02

[52] U.S. Cl. ..... 84/383 R

[58] Field of Search ..... 84/383 R, 383 A, 380, 84/382, 385 R, 453

[56] References Cited

U.S. PATENT DOCUMENTS

| | | | |
|---|---|---|---|
| 555,561 | 3/1896 | Cadwallader | 84/323 R |
| 4,185,535 | 1/1980 | Lorenzini | 84/383 R |
| 4,258,604 | 3/1981 | Giokas | 84/383 R |

*Primary Examiner*—Michael L. Gellner
*Assistant Examiner*—Cassandra C. Spyrou
*Attorney, Agent, or Firm*—R. Neil Sudol; Henry D. Coleman

[57] ABSTRACT

A device for fastening a reed on a mouthpiece of a wind instrument includes two rod members extending essentially parallel to one another, each of the rod members being provided with a plurality of annular grooves. An elongate flexible traction member or string has opposite ends fastened to respective ones of the rod members and is wound partially about the rod members so as to be partially disposed between each of the rod members and the wind instrument mouthpiece. The string is wound in alternation about the rod members so as to define arcs of partial turns having alternating directions. Screws or other adjustment components are connected to the rod members for adjusting a distance between the rod members to thereby vary a winding tension of the string, which is wound about the rod members in the grooves to obviate an exertion of pressure on the string by the rod members, whereby sliding of the string relative to the rod members during adjustment of the distance between the rod members is facilitated.

8 Claims, 2 Drawing Sheets

DEVICE FOR FASTENING THE REED ON THE MOUTHPIECE OF WIND INSTRUMENTS

BACKGROUND OF THE INVENTION

The present invention relates to a device for fastening the reed on the mouthpiece of single reed wind instruments, in particular of clarinets and saxophones.

Single-reed wind instruments, clarinets, saxophones and the like have a vibrating reed, constituted by a thin blade or lamina, which is usually made of bamboo and is tied to the mouthpiece of the instrument, by a reed holder, also known as ligature.

The inner face of the reed has a planar configuration, while the outer face, in the region affected by the reed holder, has a rounded shape with two small planar vertical edges.

A first type of reed holder is constituted by a string manually wound around the reed and the mouthpiece in several continuous and contiguous turns. To keep the string under tension, the ends thereof are fixed by placing them below the adjacent turns; the mouthpiece is provided with circular dents on the cone in the fastening region in order to keep the string turns in place.

This system has some shortcomings: first of all, the tension which can be applied to the string is small and sometimes insufficient; this device furthermore does not allow, once assembled, to adjust the string tension; finally, the preparation of the fastening requires a certain manual skill.

Reed holders are therefore usually constituted by a metal strap, or band, having a double screw clamp at each end for adjusting the securing action.

There are numerous variations of the strap holder, characterized by the material used for manufacture—metal, rigid or semirigid plastics—or characterized by a shaped profile for accommodating the reed, by the provision of the clamp on the reed or diametrically opposite thereto, or again characterized by the position, shape and number of the lightening openings of the strap.

A strap system is also known (see DAS MUSIKINSTRUMENT 3/4, March/April 1988, page 78) the winding element whereof is constituted by a plastic band which is folded at its ends so as to constitute two slots in which two rods are inserted; said rods are mutually connected by two adjustment screws. The region of contact with the reed is sometimes stiffened by means of the insertion of a metallic blade.

A system is also known which is constituted by a truncated cone made of rigid plastics which is internally provided with concentric raised rings which act as supports both for the reed and for the mouthpiece. By modifying the axial position of the cone, the securing pressure of the reed is adjusted (STRUMENTI E MUSICA 7/8, July/August 1989, page 71).

Finally, a non-winding system is also known which comprises a bridge-shaped U bolt which is provided with fastening and adjustment screws and is inserted in adapted grooves defined on the mouthpiece (DAS MUSIKINSTRUMENT 3/4, March/April 1988, page 76 and page 78).

Since the purpose of the reed holder, or fastening, is to provide a connection between an elastic vibrating element, the reed, and a rigid element, the mouthpiece, and since the reed, which is made of bamboo, is very delicate, the size of the fastening forces, as well as the uniform distribution of these forces on the reed, are very important in relation to the vibration behavior of the reed and thus to the quality of the sound which can be obtained from the musical instrument.

Fastening devices wherein the elements in contact with the reed are made of a rigid, or insufficiently flexible, material unavoidably produce nonuniform pressure distributions, with the consequent creation of excessively loaded regions and of totally unloaded regions.

U.S. Pat. No. 4,185,535 (Lorenzini) discloses a reed-holding device constituted by string sections extending from brackets and embracing the reed. The brackets are connected by thumb screws and tightening the screws draws the string sections in tension. This reed-holder can be operated easily and rapidly, as a metal band reed holding device, while it should provide a uniform pressure on the reed. The Lorenzini holder, however, has some inconveniences.

A first inconvenience s that the brackets must have a configuration matching that of the mouthpiece in order to allow proper use. A second greater inconvenience is that the device applies tension to the string sections at only two locations and tends to leave one or more of the various sections not in proper contact with the reed. A further inconvenience is caused by the configuration of the brackets: when the thumb screws are tightened the upper parts of the respective brackets are brought together while friction causes the lower parts, where the string section holes are provided, to pivot on the mouthpiece rather then sliding on it, thereby limiting the tightening that can be applied to the string sections.

U.S. Pat. No. 4,258,604 (Giokas) discloses a device similar to that of lorenzini and having the same inconveniences.

SUMMARY OF THE INVENTION

It is an object of the present invention to provide a reed fastening device having the advantages of a string ligature without the inconveniences and difficulties of application.

This aim, as well as the objects which will become apparent hereinafter, are achieved by a device for fastening the reed on the mouthpiece of wind instruments, in particular of single-reed instruments.

BRIEF DESCRIPTION OF THE DRAWINGS

Further characteristics and advantages will become apparent from the description of a preferred but not exclusive embodiment of the invention, illustrated only by way of non-limitative example in the accompanying drawings, wherein:

FIG. 1.

DESCRIPTION OF THE PREFERRED EMBODIMENTS

Figure 1:
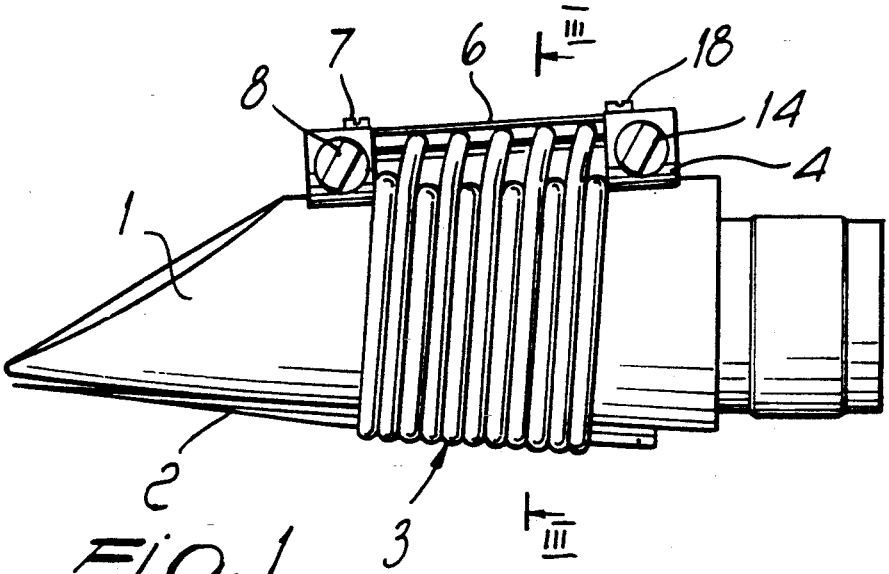
FIG. 1 is a side elevation view of the device, applied to a mouthpiece, according to the invention.
Figure 2:
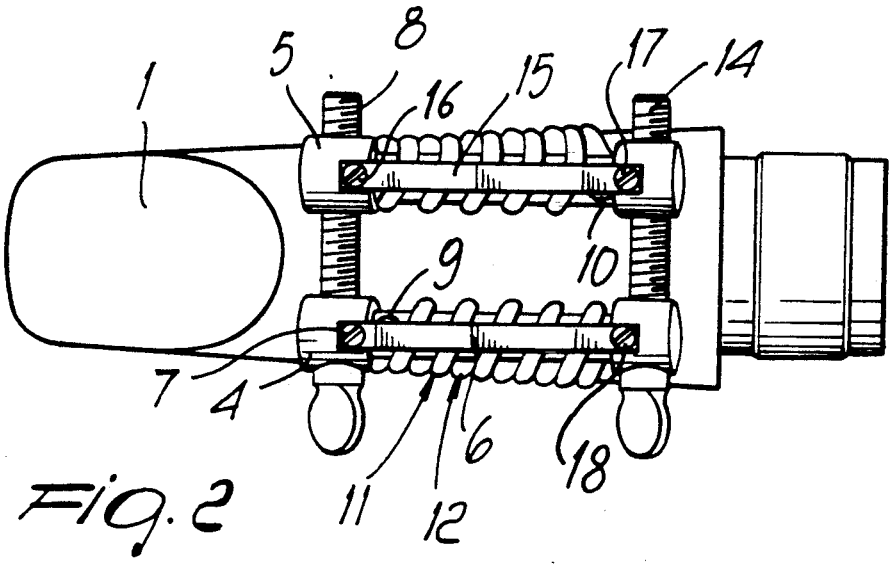
FIG. 2 is a top plan view of the device.

With reference to the above FIGURES, the device according to the invention comprises a traction member 3, which is adapted to at least partially embrace a mouthpiece 1 in order to fasten a reed 2, and a pair of rod members or bridges 4 and 5 for supporting and adjusting the traction member 3.

The traction member 3 is constituted by a string having a first end 9 and a second end 10; the first end 9 is inserted into a hole of the bridge 4 and has an expanded portion in order to prevent its extraction.

The string 3 is advantageously made of individual plastic wires with twisted stranding, and the expanded portion at the end is obtained by heating.

The string 3 is then wound around the mouthpiece 1 and the reed 2 so that the two bridges 4 and 5 cause the reversal of the direction of winding of said string and the advancement of said string by a pitch which is approximately equal to the diameter of the string itself.

The reference numerals 11 and 12 in fact indicate two turns of the strings which are contiguous but have opposite directions.

Figure 3:
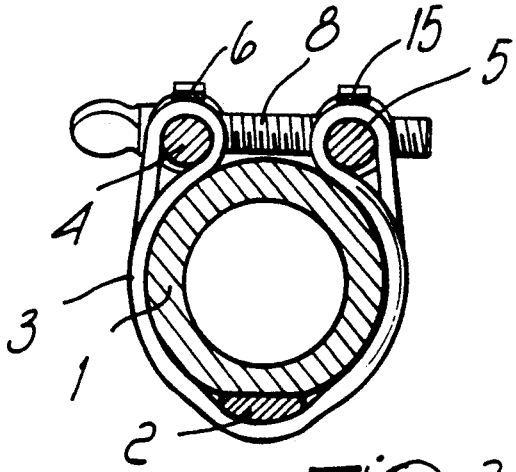
FIG. 3 is a cross sectional view, taken along the line III—III of FIG. 1.

The winding thus obtained does not cover the entire circumference of the mouthpiece and has flanking sections, or turns, arranged in alternating directions: clockwise for one turn and counterclockwise for the subsequent one, as also indicated in FIG. 3.

The second end 10 of the string also has an expanded portion and is inserted in a hole of the bridge 5.

The two bridges 4 and 5 are connected together by means of a pair of thumb screws 8 and 14 so that the distance between the bridges, and thus the tension of the string 3, is adjusted by turning said screws.

String holder members comprise a pair of rods 6 and 15 which are respectively fixed, by means of the respective screws 7, 18 and 16, 17, to the ends of the bridges 4 and 5. Rods 6 and 15 hold string 3 in position on rod members 4 and 5 even when the device is disassembled from mouthpiece 1. By screwing the screws 8 and 14, the sections of the string initially sette, each assuming the length required to uniformly distribute the tension, and then the required traction of the fastening is provided.

Figure 4:
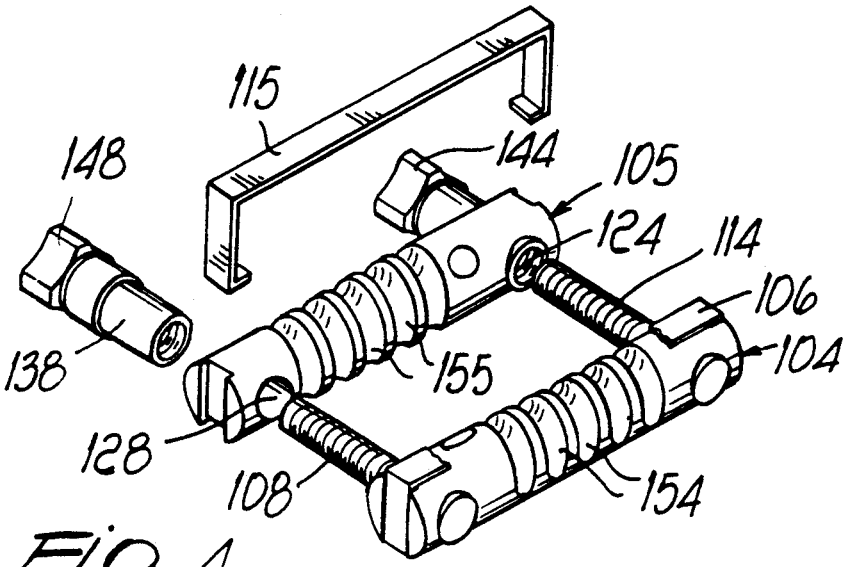
FIG. 4 is an isometric exploded partial view of the device according to a second aspect of the invention.

FIG. 4 illustrates the device according to a second aspect of the invention, wherein it comprises rod members 104 and 105 connected by two screws 108 and 114. Screws 108, 114 are forced into holes provided on rod member 104, while they can freely slide in holes 128, 124, respectively, provided on rod member 105. Nuts 134 and 138 engage screws 114 and 108, respectively, and are provided with knob portions 144 and 148, respectively. As it is apparent, turning the nuts 134 and 138, brings the rod members close together.

Each rod member 104, 105 is provided with adjacent grooves 154, 155, respectively, wherein the string sections are arranged when the device is in use.

Each rod member 104, 105 also comprises a string holder member 106, 115 constituted by, a C shaped rod elastically connected to the rod member. String holder members 106, 115 hold a string or traction member in position on rod members 104 and 105 even when the device is disassembled from a mouthpiece of a wind instrument.

The device illustrated in FIG. 4 has several advantages. The grooves 154, 155 constitute a seat for the string which can more easily slide around the rod member, in the region between the rod member and the mouthpiece surface. In fact, when the tensioning is very high the rod members press the string against the mouthpiece surface and the resulting friction may hinder the sliding of the string around the rod member. The grooves provide the necessary room for an unimpeded sliding of the string around the rod member.

A further advantage of the device illustrated in FIG. 4, is that the rod members have no threadings for engaging the screws and can therefore be made of lighter materials such as, for example, aluminum or plastics.

Figure 5:
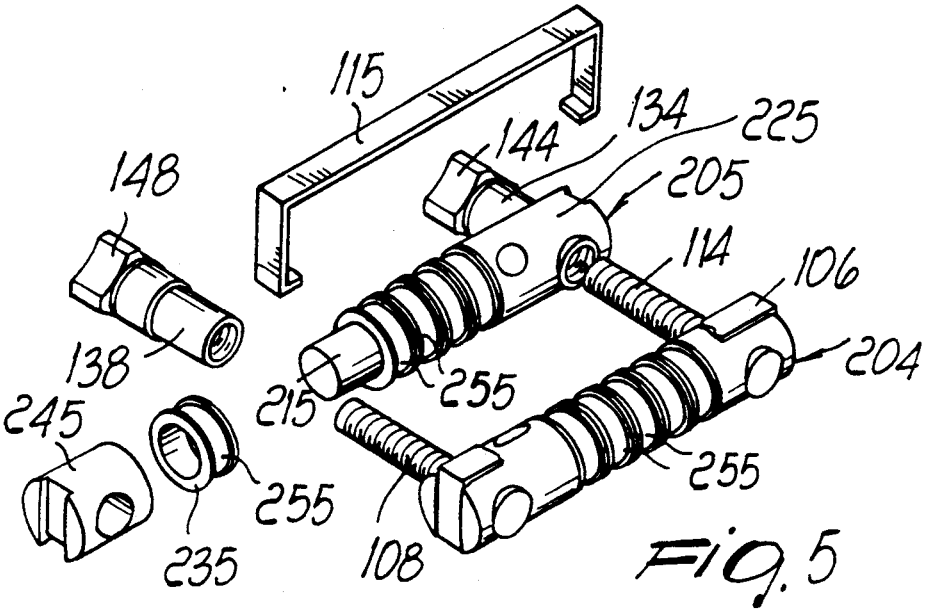
FIG. 5 is a view similar to the preceding one, of a device according to a third aspect of the invention

FIG. 5 illustrates a device similar to that of FIG. 4, wherein each of the rod members 204 and 205 is constituted by a cylindrical portion 215 having a first head 225. Cylindrical portion 215 and head 225 are provided in one piece. Rings 235 are provided on the cylindrical portion 215 and are adapted to freely rotate thereon. A second head 245 is, for example by welding, associated to the end of the cylindrical portion which is opposite to first head 225. Rings 235 are provided with grooves 255 wherein the string 3 is arranged when the device is in use.

The device illustrated in FIG. 5 has the advantage of further reducing friction, because rings 235 rotate on the rod member when the screws are tightened.

Figure 6:
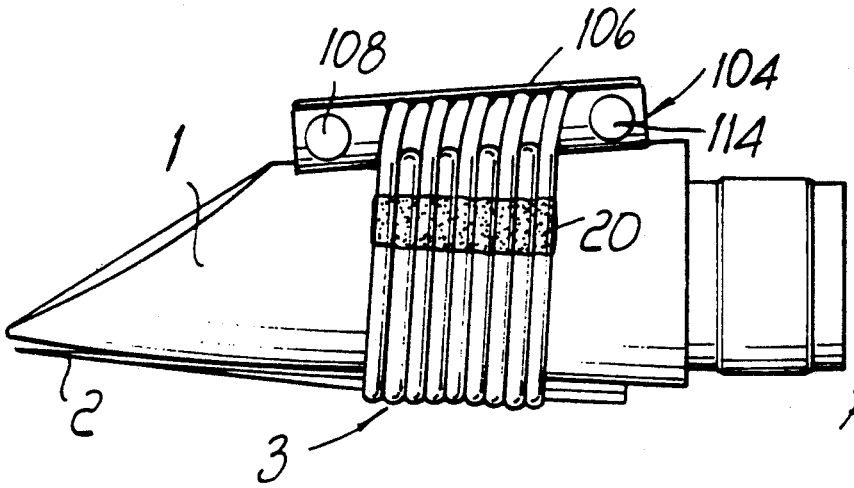
FIG. 6 is a side view of the device, according to a further aspect of the invention, applied to a mouthpiece of a wind instrument.

FIG. 6 illustrates the device, applied to a mouthpiece, according to a further aspect of the invention, wherein an elastic band 20 is applied to the string sections 3 in order to hold the string sections together on each side of the device. Elastic band 20 can be constituted by any resilient material such as glue, plastics or resin.

The elastic band 20 is adapted to allow mutual sliding of the string sections, constituting the turns, and at the same time advantageously holds the winding together when the device is disassembled, for example for substituting the reed.

Figure 7:
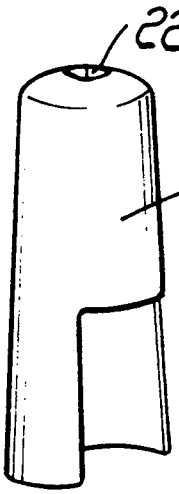
FIG. 7 illustrates a mouthpiece cover provided with a tool for operating the device according to the invention.

FIG. 7 illustrates a mouthpiece cover 21 advantageously provided with a shaped hole 22 adapted to engage knob portions 144, 148, or thumb screws 8, 14, and therefore constituting a tool for applying more strength the tightening.

It has been observed in practice, that the invention achieves the intended aim and objects, providing a device which allows the maximum degree of freedom to the vibrations of the reed and does not subject said reed to localized pressures or to permanent deformations, furthermore increasing its durability.

The ability to accumulate deformation work, due to the sliding and traction of the fibers of the string subjected to tension, gives rise to an optimum reserve of elastic energy on the reed, which is suitable for complying with and absorbing the small elastic deformations to which the reed is subjected during its vibrations.

The string furthermore adheres to the reed, accurately following its external profile, and by shaping itself along the edges with adequate compressions, increases the contact surface without generating significant localized pressure points.

This is possible because the string can easily slide around the rod members, and therefore the various sections of the string are always in proper contact with the reed and the mouthpiece.

The low friction between the string and the rod members and between the string and the mouthpiece surface, especially in the embodiments illustrated in FIGS. 4 and 5, allows for very high tensions of the string.

A further very important advantage of the invention is that the reed holder can be provided in a very limited number of sizes to fit every type of mouthpiece of different instruments and makers.

The device according to the invention allows for a fast set up of the ligature and for the adjustment of the securing tension during assembly, as well as for subsequent adjustments during the use of the instrument.

Another important advantage consists of the fact that no particular manual skill on the part of the user is required, and that the ligature can furthermore be mounted on standard mouthpieces without having to modify the mouthpiece in any way.

The device according to the invention is susceptible to numerous modifications and variations, all of which are within the scope of the inventive concept; all the details may furthermore be replaced with technically equivalent elements.

The materials employed, as well as the dimensions, may naturally be any according to the requirements and to the state of the art.

I claim:

1. Device for fastening a reed on a mouthpiece of wind instruments, in particular of single-reed instruments, comprising two rod members adapted to guide a traction member, said rod members being connected together by means of adjustment means adapted to adjust a distance between said rod members, said traction member being adapted to embrace said reed and said mouthpiece at least partially, said traction member having two ends, each one of said ends being fastened to a respective one of said rod members, said traction member being wound on said rod members so as to define arcs of incomplete turns having alternated directions in succession, said adjustment means being adapted to vary said distance between said rod members in order to vary a winding tension of said traction member, each of said rod members being provided with a plurality of annular grooves to allow said traction member to slide along an axis of said traction member, said traction member being wound about said rod members in said grooves, each of said rod members comprising a plurality of rings adapted to rotate on said rod members, each of said rings being provided with a groove, said traction member being adapted to be arranged in said groove.

2. Device according to claim 1, characterized in that each of said rod members is provided with a holder member adapted to hold said traction member in position on said rod members even when said device is disassembled from said mouthpiece.

3. Device according to claim 1, characterized in that each of said rings comprises said plurality of grooves, said traction member being adapted to slide in said grooves upon adjustment of said tension of said traction member.

4. Device according to claim 1, characterized in that it comprises a resilient member connecting said turns of said traction member, allowing mutual movements of said turns, and adapted to hold said turns of said traction member in position even when said device is disassembled from said mouthpiece.

5. A device for fastening a reed on a mouthpiece of a wind instrument, comprising:

two rod members extending essentially parallel to one another, each of said rod members being provided with a plurality of annular grooves;

an elongate flexible traction member having opposite ends fastened to respective ones of said rod members, said traction member being wound partially about said rod members so as to be partially disposed between each of said rod members and the wind instrument mouthpiece, said traction member being wound in alternation about said rod members so as to define arcs of partial turns having alternating directions;

adjustment means connected to said rod members for adjusting a distance between said rod members to thereby vary a winding tension of said traction member, said traction member being wound about said rod members in said grooves to obviate an exertion of pressure on said traction member by said rod members, whereby sliding of said traction member relative to said rod members during adjustment of said distance between said rod members is facilitated; and holder means on each of said rod members for holding said traction member in position on said rod members when the device is disassembled from the mouthpiece, said holder means including a pair of bars releasably connected to respective ones of said rod members.

6. The device defined in claim 5, further comprising a plurality of rings each provided with at least one of said grooves, said rings being mounted to said rod members.

7. The device defined in claim 6 wherein said rings are rotatably mounted to said rod members.

8. The device defined in claim 5, further comprising resilient means spaced from said rod members and connecting a plurality of turns of said traction member to one another for holding said traction member in position on said rod members when the device is disassembled from the mouthpiece.

* * * * *